US008579423B2

(12) United States Patent
Yokouchi

(10) Patent No.: US 8,579,423 B2
(45) Date of Patent: Nov. 12, 2013

(54) LIQUID SUPPLY APPARATUS AND LIQUID EJECTING APPARATUS

(71) Applicant: Seiko Epson Corporation, Tokyo (JP)

(72) Inventor: Hideya Yokouchi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/652,917

(22) Filed: Oct. 16, 2012

(65) Prior Publication Data

US 2013/0093820 A1 Apr. 18, 2013

(30) Foreign Application Priority Data

Oct. 18, 2011 (JP) ..... 2011-228638

(51) Int. Cl.
*B41J 2/175* (2006.01)

(52) U.S. Cl.
USPC ..... 347/85

(58) Field of Classification Search
USPC ..... 347/7, 84, 85; 141/18
See application file for complete search history.

(56) References Cited

U.S. PATENT DOCUMENTS

| | | | | |
|---|---|---|---|---|
| 6,540,340 | B2 * | 4/2003 | Thorpe et al. | 347/85 |
| 7,524,044 | B2 * | 4/2009 | Kumagai | 347/85 |
| 7,597,430 | B2 * | 10/2009 | Umeda | 347/85 |
| 2008/0273064 | A1 | 11/2008 | Ota et al. | |
| 2009/0153629 | A1 | 6/2009 | Yokouchi | |

FOREIGN PATENT DOCUMENTS

| | | |
|---|---|---|
| JP | 06-328723 | 11/1994 |
| JP | 2006-159811 | 6/2006 |
| JP | 2009-051050 | 3/2009 |
| JP | 2009-166473 | 7/2009 |

* cited by examiner

*Primary Examiner* — Anh T. N. Vo
(74) *Attorney, Agent, or Firm* — Workman Nydegger

(57) ABSTRACT

A liquid supply apparatus which supplies a liquid to a liquid ejecting head from a liquid accommodating unit includes a plurality of rotating type pumps which are respectively provided in the middle of each of a plurality of supply paths which connect a plurality of the liquid accommodating units and the liquid ejecting head, a common power source which drives the plurality of pumps and a power transmission adjusting unit which adjusts power which is transmitted from the power source to each pump due to the liquid pressure in the supply path on the basis of a load that the pump receives.

12 Claims, 8 Drawing Sheets

LIQUID SUPPLY APPARATUS AND LIQUID EJECTING APPARATUS

BACKGROUND

1. Technical Field

The present invention relates to a liquid supply apparatus and a liquid ejecting apparatus in which a pump is provided in the middle of a supply flow path which connects a liquid accommodating unit and a liquid ejecting head.

2. Related Art

For example, as an example of this kind of liquid ejecting apparatus, an ink jet type printer which performs printing by ejecting an ink (liquid) from nozzles of a recording head (liquid ejecting head) onto a medium such as paper (for example, refer to JP-A-2009-166473 (FIG. 1 and the like)) is widely known. An ink supply apparatus (liquid supply apparatus) which supplies an ink to the recording head from an ink cartridge (liquid accommodating unit) is provided in this kind of printer. For example, an ink supply apparatus in which a diaphragm type pump is provided in the middle of a supply path between the ink cartridge and the recording head is disclosed in JP-A-2009-166473 (FIG. 1 and the like).

Recently, although there is a case where an ink having relatively high viscosity is used, it is slightly difficult for a reciprocal pump such as a diaphragm type pump to reliably pump the ink having high viscosity in some cases. For this reason, a rotating type pump such as a gear pump capable of reliably pumping an ink is used in a printer which handles an ink having high viscosity. For example, a printer in which a gear pump (circulation pump) is provided in the middle of a flow path (circulation flow path) which connects a sub-tank and a recording head is disclosed in JP-A-2006-159811 (FIG. 6 and the like). In addition, an ink jet type printer in which an ink tank and a recording head are connected with the same number of plural flow paths as the number of ink colors and a gear pump is respectively provided in the middle of each flow path is disclosed in JP-A-6-328723 (FIG. 1, FIG. 2 and the like).

However, in a configuration in which a gear pump is respectively provided in the middle of each of the same number of plural flow paths as the number of ink colors which connect plural ink cartridges and a recording head, when a motor (power source) and a transmission gear are provided in every gear pump, the number of parts is increased and arrangement space and costs are increased. Therefore, it is preferable that plural gear pumps be driven with one common power source to achieve the decrease in the number of parts.

In this case, while the printer performs printing, all gear pumps usually rotate. Since the printer uses different ink based on the printing colors, it is not necessary to consume a predetermined amount for each color. Due to this, when the gear pump is driven at a rotation speed in accordance with color ink of a largely consumed amount, the ink pressure in an output side (discharge side) of the gear pump is excessively increased in ink where used amount is small. When the ink pressure in the output side of the pump is excessively increased, an ink ejection amount per dot is increased and color tones of a printed image are changed.

To solve such problems, for example, an ink supply apparatus in which a solenoid type clutch is provided between a power source and a pump (tube pump) is disclosed in JP-A-2009-51050 (FIG. 5, FIG. 7 and the like). In other words, a pressure sensor which detects the ink pressure in each output side (discharge side) of each pump provided in the middle of plural flow paths which connect ink accommodating units and a recording head and the solenoid type clutch which individually connects or blocks a power transmission path between the power source and each pump in every pump are provided in the ink supply apparatus. Then, when the ink pressure in the output side of the pump exceeds a threshold value, the clutch corresponding to the pump is shut off to stop the driving of the pump.

However, it is necessary to provide the pressure sensor which detects the ink pressure or the solenoid type clutch in every pump in the ink supply apparatus disclosed in JP-A-2009-51050 (FIG. 5, FIG. 7 and the like). For this reason, the number of parts is increased so that the structure of the ink supply apparatus is complicated and it is necessary that a control unit perform control to switch clutches according to detected the pressure of the pressure sensor for every pump. Therefore, there are problems in that the control of the ink supply apparatus is complicated and a burden on the control unit is increased.

SUMMARY

An advantage of some aspects of the invention is to provide a liquid supply apparatus and a liquid ejecting apparatus which can suppress unevenness in the liquid pressure in an output side of each pump among flow paths to be small with a relatively simple configuration even when each pump provided in the middle of a plurality of supply paths which connect a plurality of liquid accommodating units and a liquid ejecting head is driven by a common power source.

According to an aspect of the invention, there is provided a liquid supply apparatus which supplies a liquid to a liquid ejecting head from a liquid accommodating unit including a plurality of rotating type pumps which are respectively provided in the middle of each of a plurality of supply paths which connect a plurality of the liquid accommodating units and the liquid ejecting head, a common power source which drives the plurality of pumps, and a power transmission adjusting unit which adjusts power which is transmitted from the power source to each pump and by which when a load that the pump receives due to the liquid pressure in a discharge flow path of the supply path which discharges the liquid from the pump is equal to or less than a connection limit, the power source and the pump are connected to transmit the power from the power source to the pump and when the load exceeds the connection limit, a slip occurs in the connection for transmitting the power from the power source to the pump so that the power transmission is shut off or the transmitted power is reduced.

According to the configuration, a liquid supply from the plurality of liquid accommodating units to the liquid ejecting head is performed by driving the plurality of rotating type pumps which are respectively provided in the middle of each of the plurality of supply paths which connect the liquid accommodating units and the liquid ejecting head. The plurality of pumps are driven by the power from the common power source. At this time, the liquid pressure in the discharge flow path (flow path of the liquid ejecting head) of the pump varies on the basis of differences in a consumed amount of the liquid of each flow path, ejected from the liquid ejecting head. Here, when a liquid with a uniform amount is discharged from each pump, the liquid pressure in the discharge flow path with the small consumed liquid amount in the liquid ejecting head is relatively increased and the liquid pressure in the discharge flow path with the large consumed liquid amount in the liquid ejecting head is relatively decreased. For this reason, unevenness in the liquid pressure is generated in the supply paths of a portion which connects each pump and the liquid ejecting head. The unevenness in the liquid pressure between the supply paths causes unevenness of a liquid ejection amount from each ejecting port (for example, each nozzle) for each supply path in the liquid ejecting head. However, according to the aspect of the invention, with respect to the pump in which a load that the pump receives due to the liquid pressure in a discharge flow path is equal to or less than a connection limit, the power source and the pump are connected to transmit the power from the power source to the pump. On the other hand, with respect to the pump in which the drive load that the pump receives exceeds the connection limit, a slip occurs in the connection by the power transmission adjusting unit to transmit the power from the power source to the pump and the power transmission is shut off or the transmitted power is reduced. Accordingly, even when each pump which is respectively provided in the middle of each of the plurality of supply paths are driven by the common power source, the unevenness of the liquid pressure in the output side of the pump between the flow paths can be suppressed to be small with a relatively simple configuration. Further, the connection by the power transmission adjusting unit to transmit the power may be a non-contact connection using magnetic force and may be a connection by a fraction clutch to transmit the power through a fraction surface.

In the liquid supply apparatus, it is preferable that each pump have a pump driver provided in a pump chamber to be rotatable and the power transmission adjusting unit have one or a plurality of magnetic rotating bodies each rotating by the power from the power source and having a magnetic pole section in which different magnetic poles are alternately provided on an outer circumferential surface and the magnetic body provided in at least an outer circumferential section of each of the pump drivers and the plurality of pump drivers are arranged with a gap in which the magnetic force can work with the magnetic pole section of each magnetic rotating body so that the magnetic rotating bodies and the pump drivers are connected to transmit the power through the magnetic force.

According to the configuration, when one or the plurality of magnetic rotating bodies rotate by the power from the power source, the magnetic rotating bodies and the pump drivers are connected to transmit the power by the magnetic force generated between the magnetic pole section in which different magnetic poles are alternately provided on the outer circumferential surface of each of the magnetic rotating bodies and the magnetic body provided in at least the outer circumferential section of each of the pump drivers. When the liquid pressure in the discharge flow path of the pump is increased and a load which is applied to the pump driver exceeds the connection limit, a slip occurs in the connection through the magnetic force and the driving of the pump decelerates or stops. On the other hand, when the liquid pressure in the discharge flow path of the pump is decreased and the load is equal to or less than the connection limit, the magnetic rotating bodies and pumps are connected to transmit the power through the magnetic force and the pumps are driven. Then, since the power can be transmitted to the pump drivers from the outside of the pump chambers through the magnetic force in a non-contact manner, leakage from the pump chambers is not likely to occur.

In the liquid supply apparatus, it is preferable that one magnetic rotating body be provided and the plurality of pump drivers which form each of the pumps be arranged along the outer circumferential surface of the magnetic rotating body in a state of being arranged with a gap in which the magnetic force can work with the magnetic pole section of the one magnetic rotating body.

According to the configuration, since the power can be transmitted to the plurality of pump drivers which form each of the pumps by rotating the one magnetic rotating body through the magnetic force in a non-contact manner, the number of parts in the power transmission adjusting unit has come to be small.

In the liquid supply apparatus, it is preferable that each pump have a pump driver provided in a pump chamber to be rotatable and the power transmission adjusting unit be a fraction clutch provided on a power transmission path which individually transmits the power of the power source to each of the pump drivers.

According to the configuration, when the liquid pressure in the discharge flow path in the pump corresponding to the liquid ejecting head with the small consumed liquid amount is increased and the load that the pump driver receives is increased, a slip occurs in the connection of the fraction clutch and the pump decelerates or stops. On the other hand, when the liquid pressure in the discharge flow path in the pump is decreased and the load that the pump receives is decreased, the fraction clutch connection to the pump does not slip and the pump is driven. Since the power transmission adjusting unit is the fraction clutch, the power transmission adjustment can be realized with a relatively simple configuration.

In the liquid supply apparatus, it is preferable that the fraction clutch be interposed between a rotation shaft which rotates by the power of the power source and the pump driver which is provided to the rotation shaft to be relatively rotatable.

According to the configuration, since the fraction clutch is interposed between the rotation shaft which rotates by the power of the power source and the pump driver which is provided to the rotation shaft to be relatively rotatable, the liquid supply apparatus can be formed in a relatively compact manner.

In the liquid supply apparatus, it is preferable to provide a substrate which has a flow path forming member in which a groove for a flow path is formed and a film bonded to a surface of the flow path forming member in which the groove is formed, and in which each of the pumps is embedded between a suction flow path and the discharge flow path formed by being partitioned by the groove and the film. The one magnetic rotating body is embedded in the substrate and the plurality of pumps be radially arranged around the magnetic rotating body as a center.

According to the configuration, a thin liquid supply apparatus including the plurality of pumps can be realized.

According to another aspect of the invention, there is provided a liquid ejecting apparatus including a liquid ejecting head, the liquid supply apparatus which supplies a liquid to the liquid ejecting head by discharging the liquid sent from the liquid accommodating unit from the pump through the supply path according to the aspect and a transporting unit which transports a medium, to which the liquid ejecting head ejects a liquid, as a target. Since the liquid ejecting apparatus includes the liquid supply apparatus, it is possible to obtain the same effect as the effect of the liquid supply apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereafter, a first embodiment in which a liquid ejecting apparatus according to the invention is embodied to an ink jet type printer will be described with reference to FIGS. 1 to 5.

Figure 1:
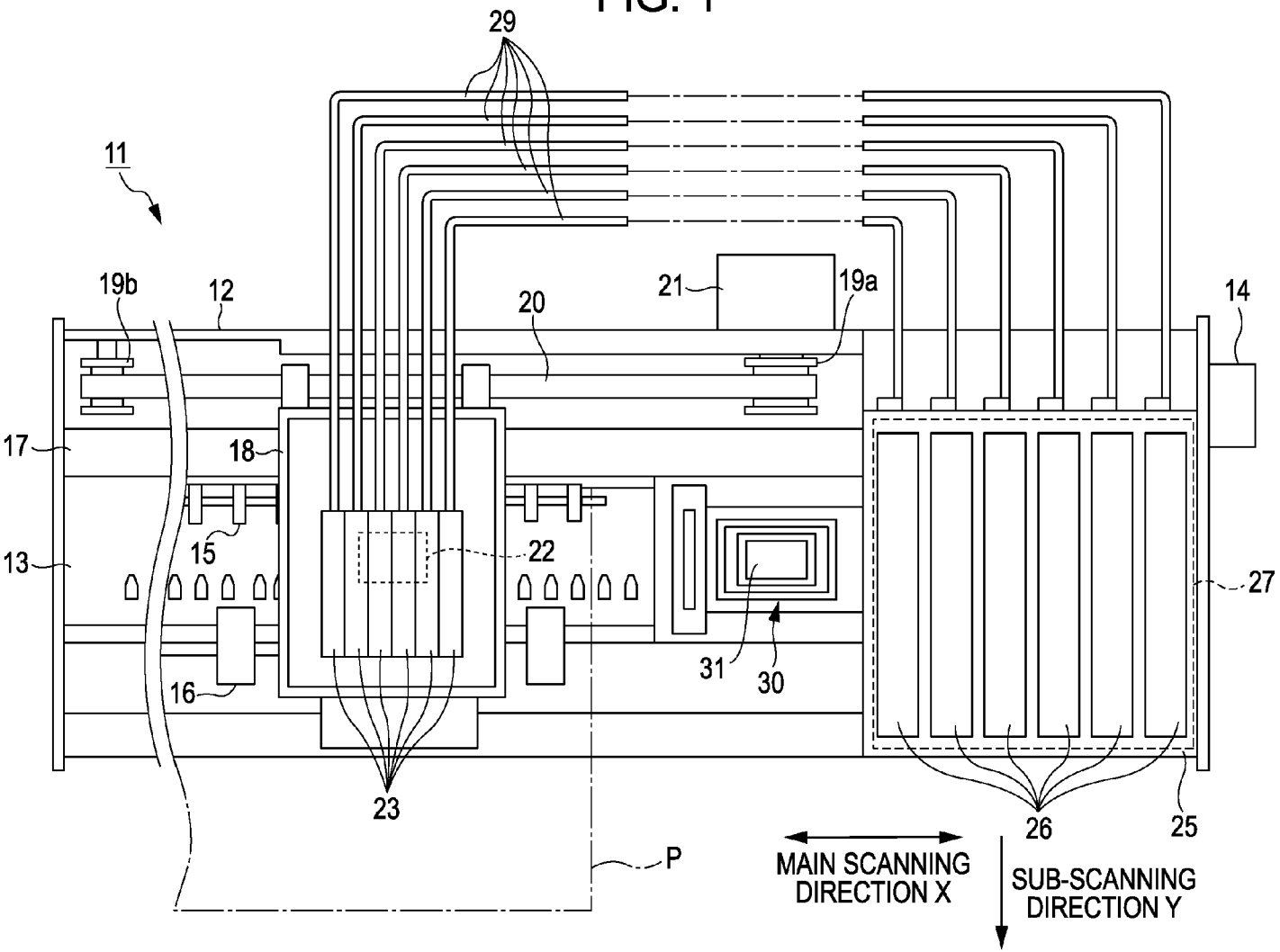
FIG. 1 is a schematic plan view of a printer according to a first embodiment.

As shown in FIG. 1, an ink jet type printer 11 as a liquid ejecting apparatus includes a main body frame 12 which has a rectangular shape as seen from a plan view and a support 13 extends along a main scanning direction X (the left and right direction in FIG. 1) in the main body frame 12. A pair of transport rollers 15 and 16 are driven by power of a transport motor 14 provided in a side end of the main body frame 12 to transport paper P (indicated by a two-dot chain line in FIG. 1) on the support 13 along a sub-scanning direction Y (a downward direction in FIG. 1). Further, an example of a transporting unit is configured with the transport motor 14, the pair of transport rollers 15 and 16 and the like in the embodiment.

Moreover, a rod-shaped guide shaft 17 which extends in the main scanning direction X is installed in an upper position of the support 13 in the main body frame 12. A carriage 18 is supported on the guide shaft 17 in a state where the carriage 18 can be reciprocally moved along the main scanning direction X. The carriage 18 is fixed to a predetermined place of an endless timing belt 20 stretched between a pair of pulleys 19*a* and 19*b* provided on rear wall inner surfaces of the main body frame 12. On the other hand, one pulley 19*a* is coupled to an output shaft of a carriage motor 21 provided on a back surface of the main body frame 12. Accordingly, the carriage 18 is reciprocally moved along the guide shaft 17 by the forward or reverse driving of the carriage motor 21.

As shown in FIG. 1, a recording head 22 which is an example of a liquid ejecting head is attached to a lower surface of the carriage 18 which faces the support 13. In the carriage 18, as many plural valve units 23, which perform pressure adjustment of an ink which is an example of a liquid supplied to the recording head 22, are mounted as ink colors. Plural nozzles 24 (all refer to FIG. 2) are opened on a nozzle forming surface 22*a* which is a lower surface of the recording head 22 and the recording head 22 performs printing by ejecting ink drops from the plural nozzles 24 onto the paper P transported on the support 13.

A cartridge holder 25 is provided in a right end in the main body frame 12 of FIG. 1, and plural (six in the embodiment) ink cartridges 26 which accommodate inks having different types (colors) and which are an example of a liquid accommodating unit are respectively and detachably mounted in the cartridge holder 25. The cartridge holder 25 is connected to an ink supply apparatus 27 made of a pump system arranged in a lower side of the cartridge holder through plural (six in the embodiment) ink supply tubes 28 (refer to FIG. 2). Then, the ink supply apparatus 27 is connected to the valve units 23 mounted in the carriage 18 through plural (six in the embodiment) ink supply tubes 29. Thus, in a state where each ink cartridge 26 is mounted on the cartridge holder 25, each ink cartridge 26 communicates with the ink supply apparatus 27 through each ink supply tube 28 and the ink supply apparatus 27 communicates with the recording head 22 through each ink supply tube 29 and the valve units 23. The ink supply apparatus 27 sucks the ink from each ink cartridge 26 and discharges the ink to the recording head 22. Further, the ink supply apparatus 27 is an example of a liquid supply apparatus in the embodiment.

In addition, as shown in FIG. 1, in a home position region of the carriage 18 which is a position toward the right end in the main body frame 12 and a standby position at the time of non-printing of the carriage 18, a maintenance apparatus 30 which performs maintenance such as cleaning of the recording head 22 is provided. The maintenance apparatus 30 includes a cap 31 which is in contact with the nozzle forming surface 22*a* of the recording head 22 (refer to FIG. 2) to perform capping in a state of surrounding each opening of each nozzle 24.

Next, a configuration of an ink supply system including the ink supply apparatus 27 will be described according to FIG. 2. Further, FIG. 2 shows only one ink supply system for convenience.

Figure 2:
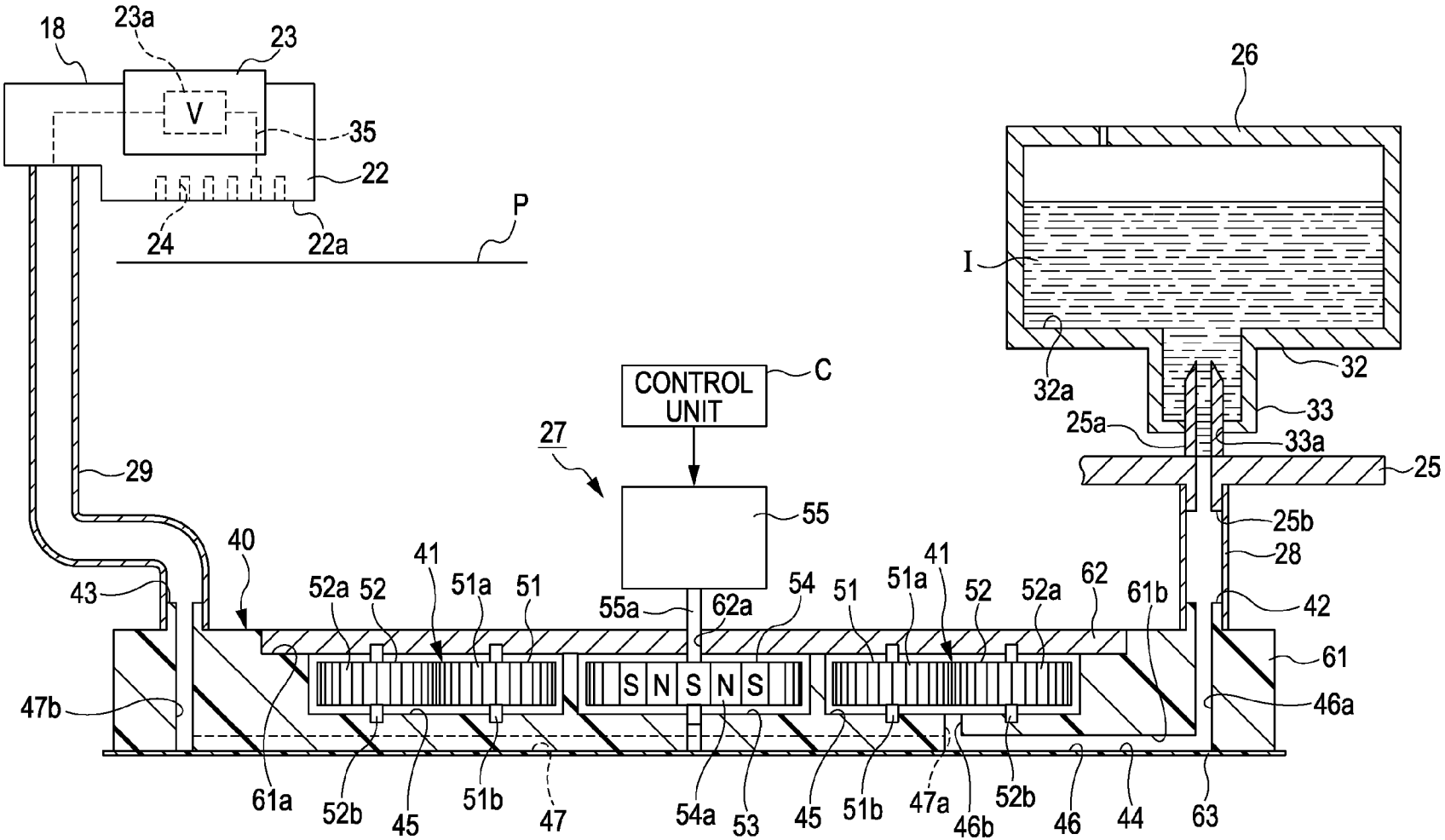
FIG. 2 is a schematic cross-sectional view showing an ink supply system of the printer.

As shown in FIG. 2, the ink cartridge 26 includes an approximately box-shaped case 32 in which ink I is accommodated and an open end (lower end) of a barrel section 33 which downwardly protrudes so as to communicate with an inside of an ink chamber 32*a* from a lower wall of the case 32 is an ink supply port 33*a* capable of drawing the ink I. Then, an ink supply needle 25*a* which is protrusively provided on an upper surface of the cartridge holder 25 is inserted into the ink supply port 33*a* of the ink cartridge 26 so that the ink cartridge 26 communicates with the ink supply apparatus 27 through the cartridge holder 25 and the ink supply tube 28.

The ink supply apparatus 27 is a pump system which employs a gear pump method and plural (six in the example) gear pumps (however, FIG. 2 shows only two) 41 corresponding to each ink cartridge 26 are embedded in a square plate-like substrate 40. Further, an example of a rotating type pump is configured with the gear pump 41 in the embodiment.

Plural (six) suction tubes 42 protrude from one end (the right end in FIG. 2) in an upper surface of the substrate 40 in FIG. 2. In addition, plural (six) discharge tubes 43 protrude from the other end (the left end in FIG. 2) in the upper surface of the substrate 40 in FIG. 2. The other ends of the ink supply tubes 28 in which one end is connected to each tube 25*b* which downwardly protrudes in a state of communicating with the ink supply needles 25*a* from lower surfaces of the cartridge holders 25 are connected to the suction tubes 42. Moreover, the other ends of the ink supply tubes 29 in which one end is connected to the valve units 23 mounted in the carriage 18 are connected to the discharge tubes 43.

Six ink flow paths 44 which respectively communicate with the six suction tubes 42 and the six discharge tubes 43 are formed in the substrate 40. Then, each of the gear pumps 41 is respectively arranged in the middle of six ink flow paths 44. In more detail, the ink flow path 44 includes a suction flow path 46 which communicates with a pump chamber 45 of the gear pump 41 from the suction tube 42 and a discharge flow path 47 which communicates with the discharge tube 43 from the pump chamber 45.

A driving gear 51 and a driven gear 52 configuring the gear pump 41 are accommodated in the pump chamber 45 in a state where tooth sections 51*a* and 52*a* are engaged with each other to be respectively rotatable. When the driving gear 51 rotates, the driven gear 52 and the driving gear 51 are synchronized with each other and rotate due to a turning force transmitted by engaging the tooth section 51*a* with the tooth section 52*a*.

A discoid magnetic rotating body 54 (magnetic rotating body) is accommodated in a cylindrical accommodating chamber 53 formed in the center position of the substrate 40 in a state where the discoid magnetic rotating body 54 is arranged in a posture in which a shaft center thereof is parallel to each shaft center of each gear 51 and 52 to be rotatable. An output shaft 55*a* of an electric motor 55 which is an example of a power source is coupled to the shaft center section of the magnetic rotating body 54. Accordingly, the magnetic rotating body 54 rotates by driving the electric motor 55. A magnetic pole section 54*a* in which N-poles and S-poles are alternately magnetized along a circumferential direction is formed in an outer circumferential section of the magnetic rotating body 54. In the embodiment, surfaces of plural magnet pieces are bonded in an array to alternately switch the N-pole and the S-pole so that the magnetic pole section 54*a* is formed on an outer circumferential surface of the magnetic rotating body 54. Needless to say, a configuration in which a magnetization coil is arranged to come close to the outer circumferential surface of the discoid magnetic body and a current flows in the magnetization coil to magnetize the outer circumferential surface of the discoid magnetic body so that the magnetic pole section 54*a* in which the N-poles and the S-poles are alternately arranged is formed can be also employed. Further, a control unit C drives the electric motor 55 at a predetermined driving speed while the printer 11 performs printing.

On the other hand, the driving gear 51 is made of a magnetic body and is formed with a metal sintered body made of iron in the example. Although the entire driving gear 51 is made of a magnetic body, it is sufficient as long as at least the tooth section 51*a* is made of a magnetic body. Each driving gear 51 is respectively arranged in a position facing the outer circumferential surface of the magnetic rotating body 54 in a state of having a predetermined gap in which the magnetic force can work with the magnetic rotating body 54. Further, in the embodiment, a power transmission adjusting unit is configured with the magnetic rotating body 54 and a portion of the driving gear 51 including the tooth section 51*a* through which magnetic lines pass.

Then, when the magnetic rotating body 54 rotates, the driving gears 51 rotate together by action of the magnetic force generated between the magnetic pole section 54*a* and the tooth section 51*a*. Thus, the gear pump 41 is driven by rotating the driving gear 51. When the gear pump 41 is driven, the ink I in the suction flow path 46 is sucked into the pump chamber 45 from a suction port 67 (refer to FIG. 3) and is discharged to the discharge flow path 47 from a discharge port 68 (refer to FIG. 3) which is opposite to the suction port 67 with interposing of an engagement place of the tooth sections 51*a* and 52*a* in the pump chamber 45. Then, the ink I that the gear pump 41 discharges to the discharge flow path 47 is supplied to the valve unit 23 mounted in the carriage 18 through the ink supply tube 29.

As shown in FIG. 2, the ink supplied to the valve unit 23 from the ink supply apparatus 27 is adjusted to a predetermined ink pressure by a pressure adjustment function of each valve unit 23 and supplied to the recording head 22. The six rows of nozzles 24 which are the same number as the number of ink cartridges 26 are opened on the nozzle forming surface 22*a* of the recording head 22 and the ink from each valve unit 23 is supplied to the ink chambers which respectively communicate with the nozzle 24. The six rows of nozzles 24 in FIG. 2 are provided with plural (for example, 180) nozzles per row which are arranged with a predetermined nozzle pitch in an orthogonal direction of a paper plane.

An ejection driving element (not shown) which comes close to the ink chamber communicating with the nozzle 24 and includes, for example, a piezoelectric element, an electrostatic element or a heater is provided in every nozzle 24 in the recording head 22. When the ejection driving element is energized, the ejection driving element imparts the ejection pressure to the ink in the ink chamber and ink drops are ejected from the nozzle 24 which communicates with the ink chamber by the ejection pressure. The size of the ink drops ejected from the nozzle 24 depends on an amount of ink which accumulates in the nozzle 24 just before the ejection pressure is imparted. For this reason, when the ink pressure in an upstream side of the valve unit 23 is high and a relatively large amount of ink is supplied to the recording head 22 at the time of valve opening of the valve unit 23, there is a tendency of relatively increasing the amount of ink which accumulates in the nozzle 24.

The valve unit 23 in the example includes a valve 23*a* which adjusts each ink supplied from the ink supply apparatus 27 to have a predetermined ink pressure and supplies the ink to recording head 22. The valve 23*a* is an on-off valve which ejects ink from the nozzle 24 to refill an ink amount corresponding to the consumed ink amount. The valve 23*a* of the embodiment is a diaphragm type differential pressure regulating valve which is opened or closed by using the differential pressure between the ink pressure in a valve chamber and the atmospheric pressure in an outer side of a diaphragm forming a part of the valve chamber. Needless to say, as long as the valve 23*a* has an ink refill function and an ink pressure adjustment function, the valve 23*a* may be a differential pressure regulating valve having other structure.

When the ink is consumed and the ink pressure in the valve chamber is decreased, a valve body of the valve 23*a* is displaced in a valve opening position due to the differential pressure so that the ink in the upstream side (in the gear pump 41) flows into the valve chamber. Therefore, for the valve 23*a* of the plural valves 23*a* by ink color which has a relatively small consumed amount of the ink ejected from the nozzle 24, the ink pressure (liquid pressure) in the output side (discharge side) (in the discharge flow path 47) of the gear pump 41 is excessively increased and the amount of ink flowing into the valve chamber at the time of the valve opening is increased in comparison with the time of normal pressure so that an ink amount in an ink flow path 35 from the valve chamber to the nozzle 24 is increased. In this case, since the ink ejection is performed in a state where the amount of ink which accumulates in the nozzle 24 just before the ejection is excessive, an ink ejection amount per ejection from the nozzle 24 is increased. Further, even when there is another differential pressure regulating valve between the valve unit 23 and the recording head 22, in case where the ink pressure in an upstream side of the differential pressure regulating valve is excessively increased, the amount of ink which accumulates in the nozzle 24 is similarly increased. Further, an example of a supply path is configured with the ink supply tubes 28 and 29, the ink flow path 44 (suction flow path 46 and discharge flow path 47) in the ink supply apparatus 27 and the ink flow path 35 in the embodiment.

Since the ink supply apparatus 27 of the embodiment employs a method in which the gear pump 41 is driven by the magnetic force generated between the rotating magnetic rotating body 54 and the driving gear 51, when the ink pressure in the output side of the gear pump 41 is increased and a drive load that driving gear 51 receives caused by the high ink pressure exceeds a connection limit, a slip occurs in a connection between the magnetic rotating body 54 and the driving gear 51. For this reason, the rotation speed of the gear pump 41 is relatively reduced due to the slip and an ink discharge amount of the gear pump 41 is reduced. Therefore, it is avoided that the ink pressure in the output side of the gear pump 41 is excessively increased.

Next, the detailed configuration of the ink supply apparatus 27 will be described on the basis of FIGS. 2 to 5.

As shown in FIG. 2, the substrate 40 which configures the ink supply apparatus 27 includes a square plate-like flow path forming member 61 made of synthetic resin, a lid body 62 which covers a concave section 61*a* formed in the flow path forming member 61 for the pump chamber 45 and the accommodating chamber 53 with a lid and a film 63 which is attached to a forming surface (rear surface) of a groove 61*b* formed in the flow path forming member 61 for the ink flow path 44 by welding. The flow path forming member 61 has the suction tube 42 which is protrusively provided in the upper right end in FIG. 2 and the discharge tube 43 which is protrusively provided in the upper left end in FIG. 2.

The concave section 61*a* includes six (however, two in FIG. 2) concave sections 65 for a pump chamber respectively forming a part of each pump chamber 45 and one concave section 66 for an accommodating chamber forming a part of the accommodating chamber 53. The driving gear 51 and the driven gear 52 are accommodated in each of the concave sections 65 in a state of being engaged with each other and the magnetic rotating body 54 is accommodated in the concave section 66 which is formed in the center position of the flow path forming member 61 in the state of being rotatable. Then, the plate-like lid body 62 is fixed to the concave section 61*a* of the flow path forming member 61 so that the pump chamber 45 and the accommodating chamber 53 are partitioned in the substrate 40. The output shaft 55*a* of the electric motor 55 is inserted into an insertion hole 62*a* which passes through an approximately center position of the lid body 62. The lid body 62 is sealed at a circumferential edge thereof in a liquid-tight state with respect to the flow path forming member 61.

Figure 3:
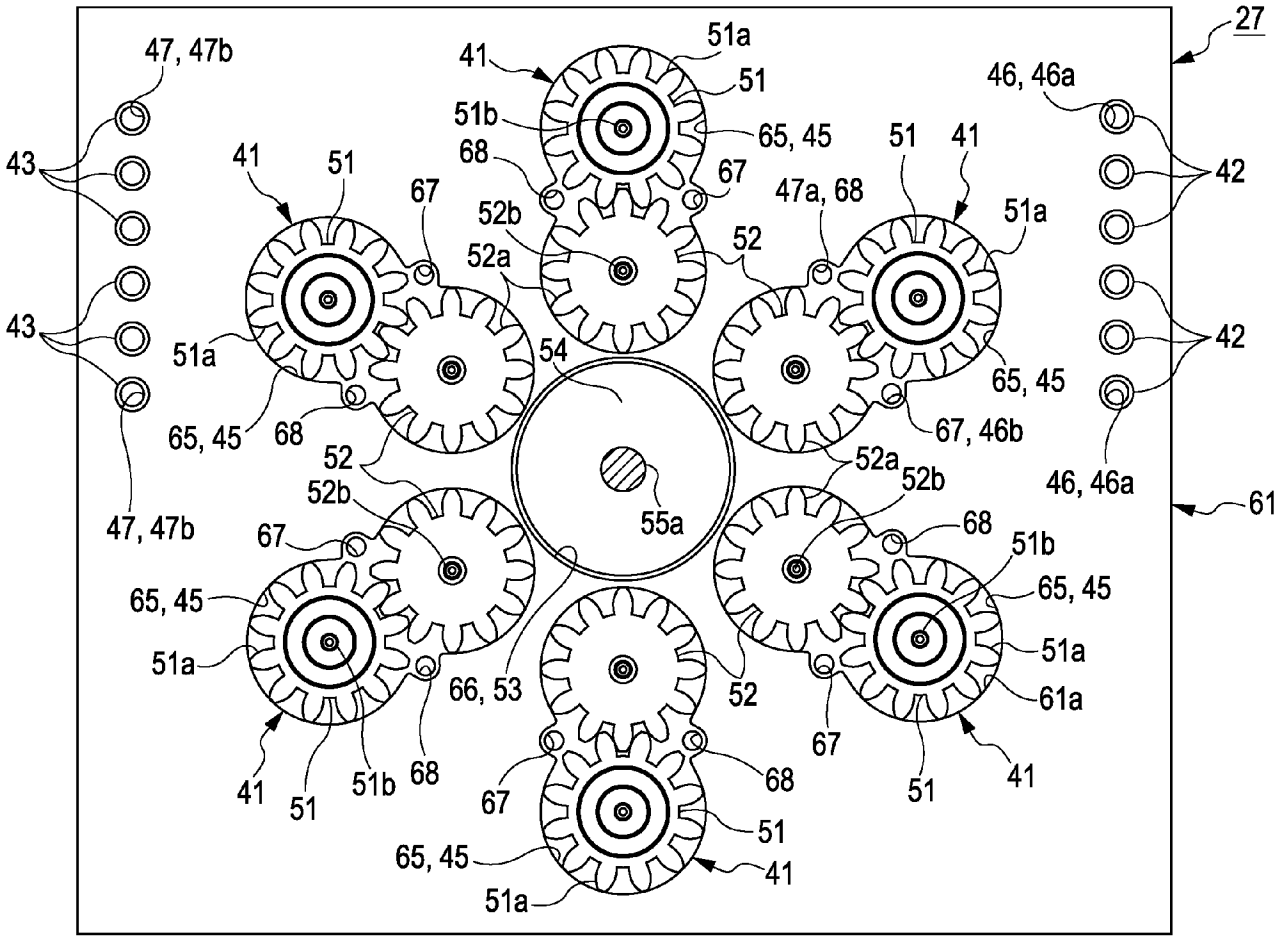
FIG. 3 is a schematic plan view showing an ink supply apparatus.

As shown in FIG. 3, the concave section 65 for a pump chamber is formed in an outer shape in which two circles are partially overlapped with each other on one surface (surface) of the flow path forming member 61 as seen from a plan view. Then, the six concave sections 65 are radially arranged around the concave section 66 for an accommodating chamber as a center in a direction in which a longitudinal direction thereof (in a direction in which shaft lines of each gear 51 and 52 are tied when the gears are accommodated in the concave section 65) is identical with a radiation direction. Then, both gears 51 and 52 are respectively accommodated in the concave section 65 so that the driving gear 51 is positioned toward the concave section 66 and the driven gear 52 is positioned away from the concave section 66. A partition wall between the concave section 66 for an accommodating chamber and the concave section 65 for a pump chamber is set to have a thickness in which a predetermined gap in which the magnetic force of the magnetic pole section 54*a* of the magnetic rotating body 54 accommodated in the concave section 66 can affect the driving gear 51 accommodated in each of the concave sections 65 can be secured between the magnetic rotating body 54 and the driving gear 51. Moreover, it is sufficient to provide one common magnetic rotating body 54 which transmits power (magnetic force) to each driving gear 51 for each driving gear 51 by radially arranging the plural driving gears 51 around the magnetic rotating body 54.

As shown in FIG. 3, the suction port 67 and the discharge port 68 are opened on a bottom surface of the pump chamber 45 on both sides in which the engagement place of each gear 51 and 52 is interposed therebetween. When the gear pump 41 is driven, the ink in the suction flow path 46 is sucked into the pump chamber 45 from the suction port 67 and the ink in the pump chamber 45 is discharged to the discharge flow path 47 from the discharge port 68.

Figure 4:
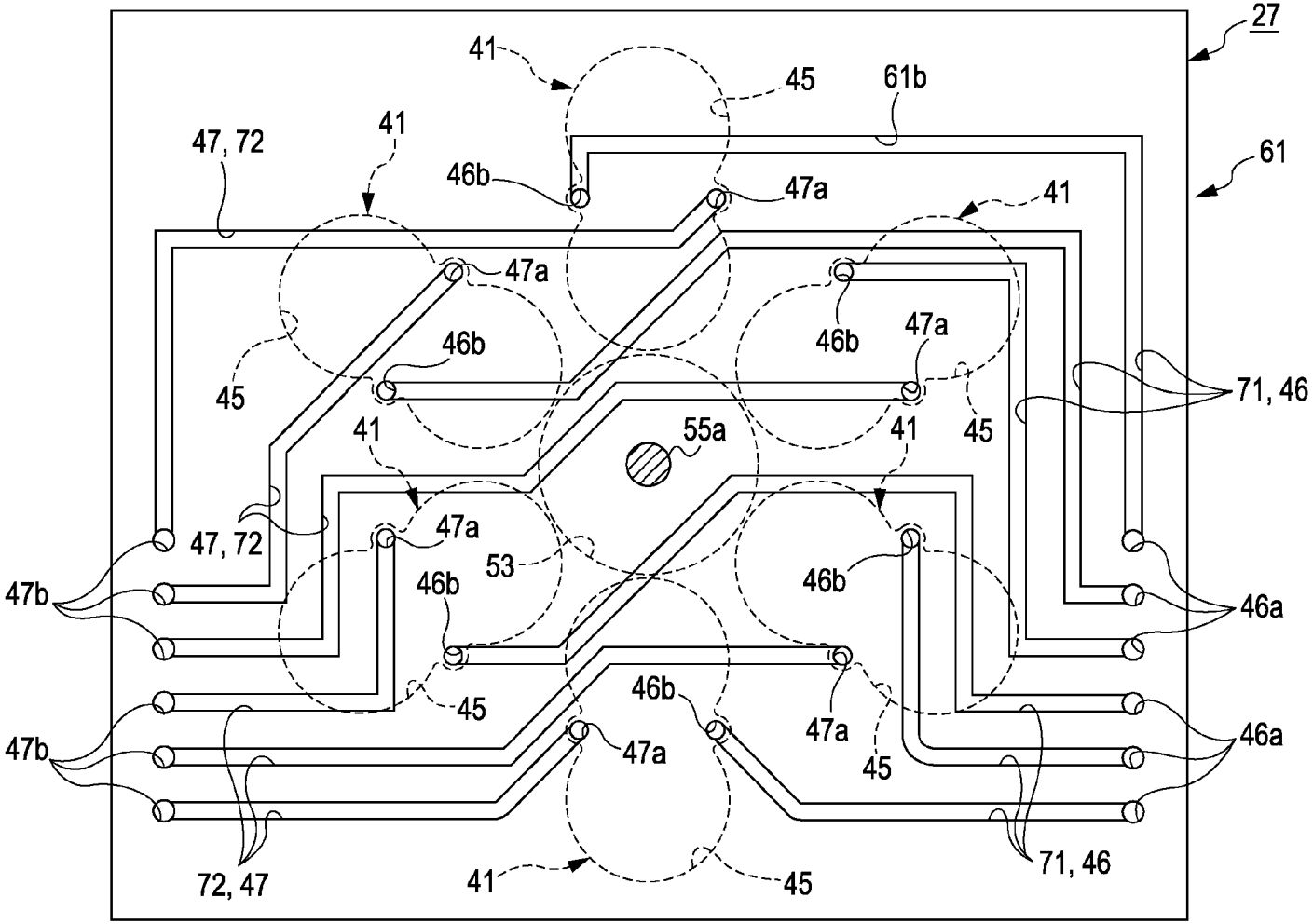
FIG. 4 is a schematic bottom view showing the ink supply apparatus.

As shown in FIG. 4, six grooves 71 which form a part of the suction flow paths 46 that communicate between the suction tubes 42 and the pump chambers 45 and six grooves 72 which form a part of the discharge flow paths 47 that communicate between the discharge tubes 43 and the pump chambers 45 are formed on the other surface (rear surface) of the flow path forming member 61.

Both ends of the groove 71 communicate with a through hole 46*a* which passes through the flow path forming member 61 in a thickness direction to communicate with the suction tube 42 in the opposite position of the suction tube 42 and a through hole 46*b* which passes through the flow path forming member 61 in the thickness direction to communicate with the suction port 67 in the opposite position of the suction port 67. In addition, both ends of the groove 72 communicate with a through hole 47*a* which passes through the flow path forming member 61 in the thickness direction to communicate with the discharge port 68 in the opposite position of the discharge port 68 and a through hole 47*b* which passes through the flow path forming member 61 in the thickness direction to communicate with the discharge tube 43 in the opposite position of the discharge tube 43. Then, the film 63 is bonded on the rear surface of the flow path forming member 61 by, for example, thermal welding so that the suction flow path 46 is formed by a portion formed by being surrounded by the groove 71 and film 63 and the through holes 46*a* and 46*b*. Moreover, the discharge flow path 47 is formed by a portion formed by being surrounded by the groove 72 and film 63 and the through holes 47*a* and 47*b*. In addition, a gas permeable material (for example, aluminum deposited film) which can effectively prevent air from gas-permeating though the film and dissolving in the ink is used as the film 63 which forms a flow path.

Furthermore, the driving gears 51 are maintained in the pump chambers 45 in a rotatable state by inserting each shaft section 51*b* of each driving gear 51 into each shaft hole provided in positions where bottom surfaces of the concave sections 65 of the flow path forming member 61 correspond to an inner surface of the lid body 62. In addition, the driven gears 52 are maintained in the pump chambers 45 in a rotatable state by inserting each shaft section 52*b* of each driven gear 52 into each shaft hole provided in positions where bottom surfaces of the concave sections 65 of the flow path forming member 61 correspond to an inner surface of the lid body 62.

Figure 5:
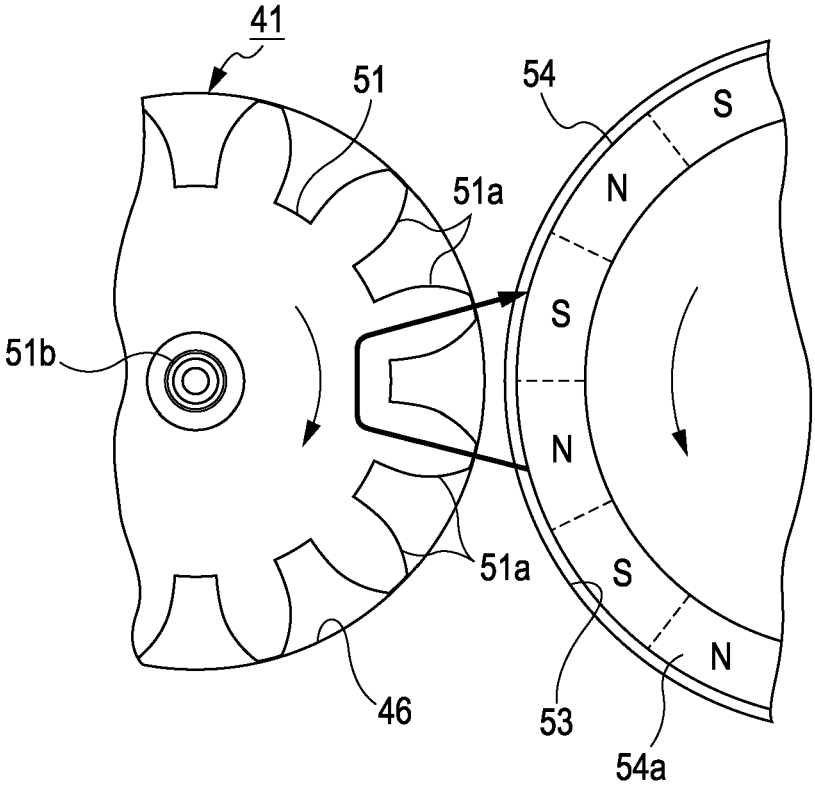
FIG. 5 is a partial plan view describing a driving principle of a gear pump.

As shown in FIG. 5, the N-pole and the S-pole of the magnetic pole section 54*a* are formed with the same pitch as the pitch of the tooth section 51*a* of the driving gear 51. For this reason, as shown in FIG. 5, the magnetic lines are formed in a path going through two tooth sections 51*a* adjacent to the driving gear 51 between the N-pole and the S-pole adjacent to the magnetic pole section 54*a* in a place where the tooth section 51*a* of the driving gear 51 faces the magnetic pole section 54*a* of the magnetic rotating body 54. In other word, the magnetic lines are formed in the path entering the facing tooth section 51*a* from the N-pole and returning to the S-pole from the adjacent tooth section 51*a*. Suction force works between the magnetic pole section 54*a* and the tooth section 51*a* by the magnetic lines and the tooth section 51*a* in which the magnetic lines are formed is sequentially moved according to the rotation of the magnetic rotating body 54 so that the suction force continuously works to rotate the driving gear 51 with the rotation of the magnetic rotating body 54.

Next, the working of the printer 11 including the ink supply apparatus 27 configured as described above will be described.

While the printer 11 performs printing, the electric motor 55 is driven by the control unit C at a predetermined rotation speed according to a print mode. That is, during the printing, the electric motor 55 is usually driven. The magnetic rotating body 54 rotates by driving the electric motor 55. Due to the magnetic force which works between the magnetic pole section 54*a* of the magnetic rotating body 54 and the tooth section 51*a* of the driving gear 51, the driving gear 51 rotates with the magnetic rotating body 54 in a non-contact manner.

When the driving gear 51 rotates, the driven gear 52 rotates through the engagement of the tooth sections 51*a* and 52*a*, the ink is sucked into the pump chamber 45 from the suction port 67 and the ink in the pump chamber 45 is discharged from the discharge port 68. In this manner, the ink is supplied from the ink cartridge 26 to the recording head 22 by the discharge force of the gear pump 41. When the ink is ejected from the nozzle 24 and consumed, the ink in the valve chamber of the valve 23*a* is reduced and the pressure is reduced so that the valve 23*a* is opened on the basis of the differential pressure due to the reduced pressure and the ink flows into the recording head 22.

Here, the driving speed of the electric motor 55 is determined on the basis of the ink with the most consumed ink amount from the nozzle 24 among plural color inks (six colors in the example). That is, the driving speed of the electric motor 55 is determined according to a supposed maximum ink consuming speed determined on the basis of the print mode. Therefore, while the printer 11 performs printing, all gear pumps 41 usually rotate.

Due to this, when the consumed ink amount ejected from the nozzle 24 is relatively small and the ink pressure in the output side of the gear pump 41 is increased so that the drive load that the gear pump 41 receives caused by the ink pressure in the output side exceeds the connection limit, a slip occurs in the connection between the magnetic pole section 54*a* and the tooth section 51*a* by the magnetic force. As a result, the gear pump 41 decelerates or stops. Therefore, it is avoided that the ink pressure in the output side of the gear pump 41 is excessively increased and the ink pressure can be suppressed to have a value in an acceptable range. Consequently, unevenness in an ink ejection amount per dot among ink types is suppressed to be small to avoid a defect that color tones of a printed image are changed. Meanwhile, when the consumed ink amount ejected from the nozzle 24 is relatively large, the ink pressure in the output side of the gear pump 41 is not so increased and the drive load that the gear pump 41 receives caused by the ink pressure in the output side is equal to or less than the connection limit, a slip does not occur in the connection between the magnetic pole section 54*a* and the tooth section 51*a* by the magnetic force. Therefore, the gear pump 41 does not decelerate and is driven at a prescribed speed to supply ink with the necessary ink pressure.

As described above, the following effects can be obtained according to the embodiment.

(1) A magnetic power transmission adjusting unit is provided on a transmission path which transmits the power of the electric motor 55 to each gear pump 41. Due to this, while the drive load, that the driving gear 51 of the gear pump 41 receives, caused by the ink pressure in the discharge flow path 47 is equal to or less than the connection limit, the magnetic pole section 54*a* and the tooth section 51*a* are connected by the magnetic force which works between the magnetic pole section 54*a* and the tooth section 51*a* and the power is reliably transmitted to supply the ink with the necessary ink pressure. On the other hand, when the drive load, that the driving gear 51 receives, exceeds the connection limit, a slip occurs in the connection by the magnetic force which works between the magnetic pole section 54*a* and the tooth section 51*a* and the gear pump 41 decelerates or stops. As a result, the gear pump 41 in which the consumed ink amount in the recording head 22 is large and the ink pressure in the discharge flow path 47 is relatively low is driven, while the gear pump 41 in which the consumed ink amount in the recording head 22 is small and the ink pressure in the discharge flow path 47 is relatively high decelerates or stops and the amount of the supplied ink is reduced or the ink supply stops. Consequently, unevenness in the ink pressure between the flow paths which connect each gear pump 41 and the recording head 22 can be suppressed to be small. Accordingly, unevenness in the ink ejection amount of the recording head 22 among inks can be suppressed to be small. For this reason, it is not likely to change color tones of a printed image and an image with high print quality can be printed.

(2) Although the electric motor 55 is usually driven while the printer 11 performs printing, since it is possible to prevent the ink pressure in the output side of the gear pump 41 from being excessively increased, the excessive ink supply to the recording head 22 can be avoided. Therefore, for example, a sensor, which detects the ink pressure required in a case where a configuration, in which a speed control of the electric motor 55 is performed, is employed, does not need to be provided to prevent the ink pressure from being excessively increased. For this reason, it is unnecessary for the control unit C to perform a complicated control such as the speed control of the electric motor 55 on the basis of detection signals from the plural sensors.

(3) The magnetic pole section 54*a* in which the different magnetic poles (N-poles and S-poles) are alternately arranged on the outer circumferential surface of the magnetic rotating body 54 which rotates by the power of the electric motor 55 and the tooth section 51*a* of the driving gear 51 made of the magnetic body (metal sintered body) are connected through the magnetic force. Therefore, since the power can be transmitted from an outer side of the pump chamber 45 by the magnetic force in a non-contact manner, it is possible to reduce ink leakage from the pump chamber 45.

(4) The ink supply apparatus 27 has a configuration in which one gear pump 41 is provided in every ink cartridge 26. Then, one common electric motor 55 is provided for all gear pumps 41. Therefore, it is possible to suppress the number of parts to be small and to avoid the increase of arrangement space and costs.

(5) Since the driving gear 51 is formed with a magnetic body and only one magnetic rotating body 54 is provided, the power transmission adjusting unit which adjusts the power transmitted to the driving gear 51 from the electric motor 55 can be realized with a relatively simple configuration.

(6) Since the ink supply apparatus 27 has a thin structure in which the plural (for example, six) gear pumps 41 are arranged on the square plate-like substrate 40 in a planar manner and are embedded, an arrangement space may be reduced to contribute to miniaturization of the printer 11, for example.

Second Embodiment

Next, a second embodiment will be described on the basis of FIGS. 6 and 7. The second embodiment is an example in which a power transmission adjustment is realized by a fraction clutch. Further, the same reference numerals are attached to the same configuration as in the first embodiment, the description will be omitted and only particularly different configurations will be described.

Figure 6:
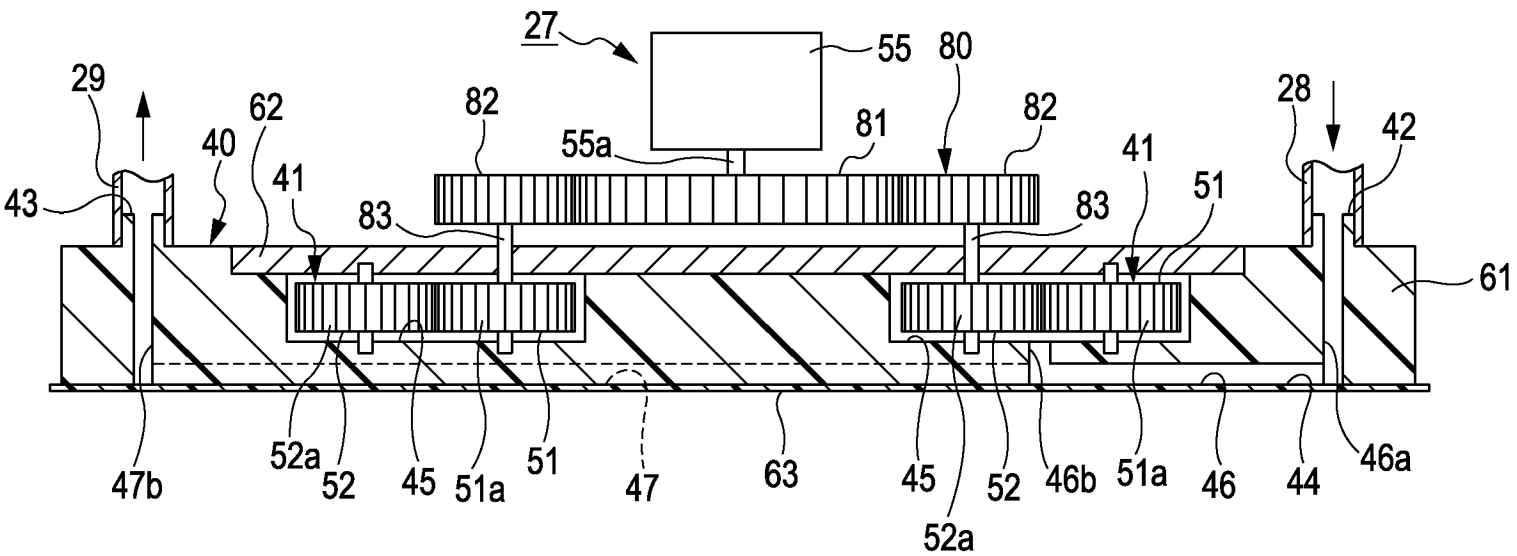
FIG. 6 is a schematic cross-sectional view showing an ink supply apparatus according to a second embodiment.

As shown in FIG. 6, a power transmission mechanism 80 which is configured with gear rows is provided between the electric motor 55 and each gear pump 41. The power transmission mechanism 80 includes a first gear 81 with a large diameter which is coupled to the output shaft 55*a* of the electric motor 55 and plural (six in the example) (however, only two in FIG. 6) second gears 82 with a small diameter which are arranged around the first gear 81 with a predetermined gap in a state where the second gears 82 are engaged with the first gear 81. Each rotation shaft 83 coupled to each shaft center section of each second gear 82 passes through the lid body 62 and is coupled to each shaft center section of each driving gear 51 configuring each gear pump 41. Accordingly, when the electric motor 55 is driven, the power is transmitted to the driving gears 51 through the first gear 81 and the second gears 82 and the driving gears 51 and the driven gears 52 rotate.

Figure 7:
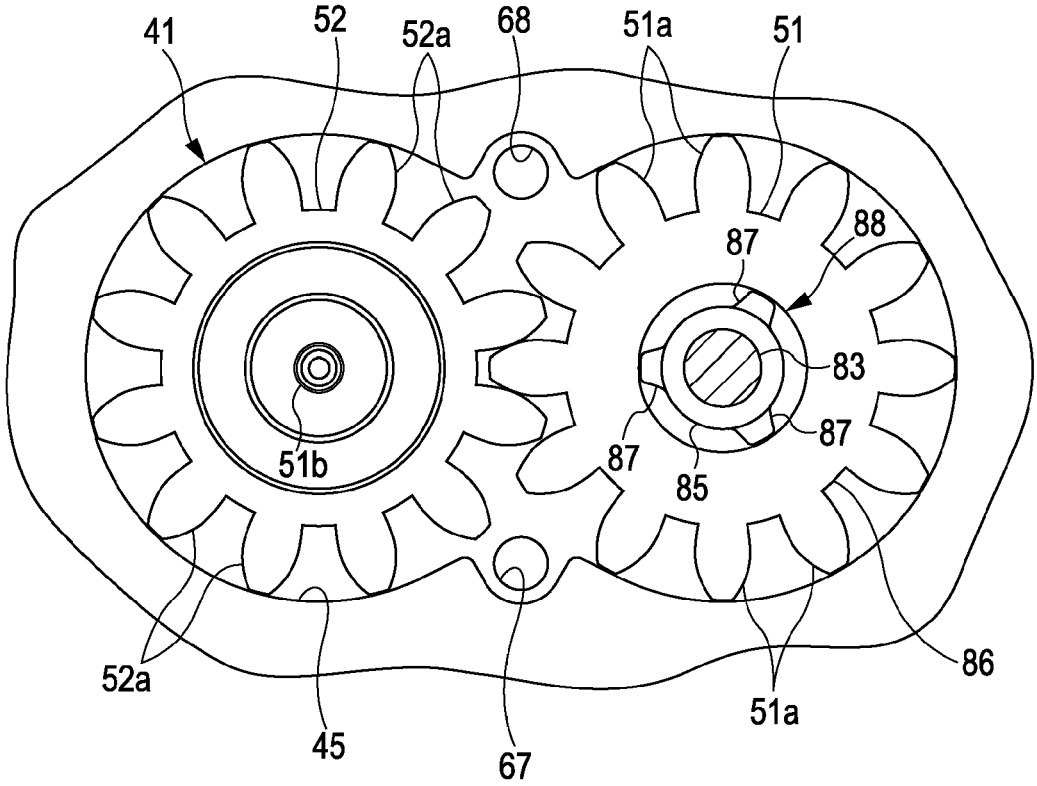
FIG. 7 is a schematic plan view showing a schematic configuration of a gear pump.

Furthermore, as shown in FIG. 7, the driving gear 51 includes a cylindrical inner race member 85 to which the rotation shaft 83 is coupled and an annular outer race member 86 which is assembled to be relatively rotatable in an outer circumferential side of the inner race member 85. In an outer circumferential section of the outer race member 86, the plural tooth sections 51*a* are formed along the outer circumferential section with a predetermined pitch. Then, plural (three in the example) springs 87 are interposed between an outer circumferential surface of the inner race member 85 and an inner circumferential surface of the outer race member 86 in a state where the plural springs 87 are arranged in positions with a substantially equally-spaced gap in a circumferential direction. The springs 87 of the example are configured with, for example, U-shaped sectional plate springs which are locked on the outer circumferential surface of the inner race member 85 and are biased toward the outer side of the outer race member 86. That is, the fraction clutch 88 is configured with the outer circumferential surface of the inner race member 85, the inner circumferential surface of the outer race member 86 and the springs 87. Therefore, while the drive load that the driving gear 51 (outer race member 86) receives is equal to or less than the connection limit, the springs 87 and the inner circumferential surface (engagement surface) of the outer race member 86 are engaged in a frictional manner so that the inner race member 85 and the outer race member 86 integrally rotate due to the fractional engagement force.

Since the consumed ink amount is small, when the ink pressure in the discharge flow path of the gear pump 41 is increased and the drive load that the driving gear 51 receives exceeds the connection limit, a slip occurs in a connection between the springs 87 and the outer race member 86 of the fraction clutch 88 and the gear pump 41 decelerates or stops. Therefore, since the ink pressure in the discharge flow path 47 of the gear pump 41 is not excessively increased, unevenness of the ink drops is suppressed to be small and a defect that color tones of a printed image are changed is not likely to occur.

Therefore, the following effect can be obtained according to the second embodiment.

(7) Since the fraction clutch 88 is used, a power transmission adjustment can be realized with a relatively simple configuration. In particular, the driving gear 51 is configured with the cylindrical inner race member 85 which is coupled to the rotation shaft 83 to be integrally rotatable and the outer race member 86 which is provided to be relatively rotatable with respect to the rotation shaft 83 (that is, the inner race member 85), and the fraction clutch 88 is configured with the outer circumferential surface of the inner race member 85, the inner circumferential surface of the outer race member 86 and the springs 87 which are interposed between the outer circumferential surface of the inner race member 85 and the inner circumferential surface of the outer race member 86. Therefore, the fraction clutch 88 is simply configured.

Moreover, the above embodiment can be modified into embodiments as below.

Figure 8:
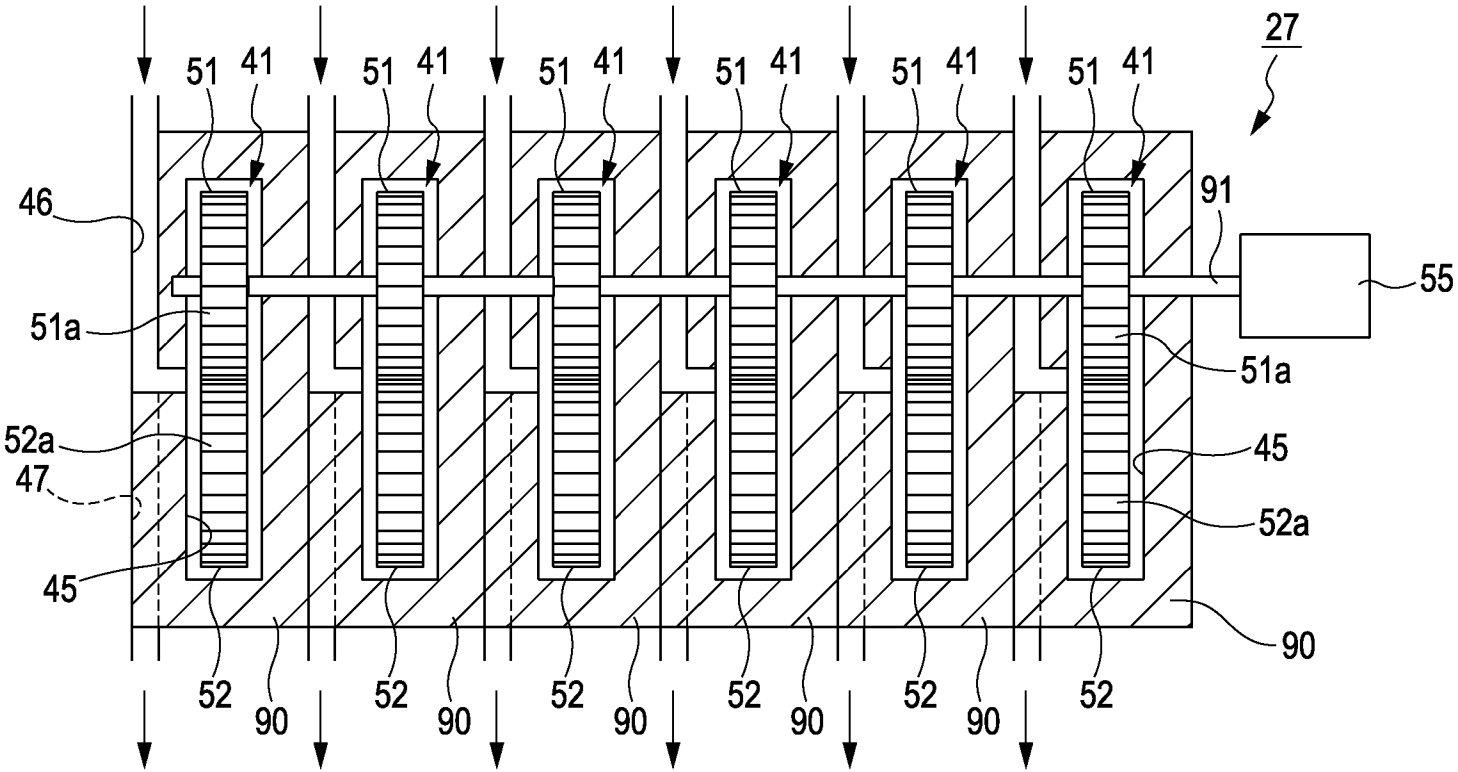
FIG. 8 is a schematic side sectional view showing an ink supply apparatus according to a modification example.

The ink supply apparatus 27 can have a structure in which the gear pumps are arranged in a state of being laminated as shown in FIG. 8. That is, as shown in FIG. 8, plural (six in the example) flow path forming members 90 of a square plate-like shape which accommodate the gear pumps 41 in the respectively formed pump chambers 45 are laminated in the shaft lines direction of the driving gears 51 and the driven gears 52 in a state where the shaft lines of all driving gears 51 which configure each gear pump 41 respectively embedded are identical. The driving gear 51 has the same configuration as in FIG. 7 and includes the fraction clutch 88 in which the springs 87 are interposed between the inner race member 85 and the outer race member 86. A rotation shaft 91 which is coupled to the output shaft of the electric motor 55 is coupled to each inner race member 85 of the plural (six in the example) driving gears 51. When the rotation shaft 91 rotates, the inner race member 85 rotates and the outer race member 86 rotates with the inner race member 85 through the fraction clutch 88. Further, it is preferable that the fraction clutch 88 be covered to be in a liquid-tight state. This is because frictional force is changed to cause unevenness in ink pressure in the output side of the gear pump 41 when the ink attached to the fraction clutch 88 dries or is thickened.

In the configuration in FIG. 8, a magnetic power transmission mechanism may be employed instead of the fraction clutch 88. That is, the magnetic pole section in which the N-poles and the S-poles are alternately arranged in the circumferential direction is provided on the outer circumferential surface of the inner race member and convex sections having the same pitch as the pitch of the N-pole and the S-pole of the magnetic pole section are formed on the inner circumferential surface of the outer race member along the inner circumferential surface. When a load caused by the ink pressure that the outer race member receives is increased and exceeds the connection limit, a slip occurs in a connection of the inner race member and the outer race member due to magnetic force so that the gear pump 41 decelerates or stops. Further, in the configuration, the inner race member in which the magnetic pole section is formed in the outer circumferential section corresponds to the magnetic rotating body. In such a manner, the magnetic rotating body may be provided in plural.

There is no limitation to a configuration in which the power is transmitted from the one magnetic rotating body 54 to the plural driving gears 51 and the magnetic rotating body may be provided in every driving gear. In addition, a configuration in which N driving gears are divided into M groups (however, $M<N$) and the one magnetic rotating body is provided in every group can be employed. For example, two magnetic rotating bodies are embedded in the substrate 40 and the gear pumps are radially arranged around the two magnetic rotating bodies, for example, in sets of three.

The fraction clutch is not limited to the structure shown in FIG. 7. For example, the fraction clutch may have a gear, a cylinder which is coaxially mounted to the gear to be relatively rotatable and a spring which is biased so as to press the gear to the cylinder and may be maintained in a fractional engagement state by performing pressure welding on a contact surface (clutch surface) of the gear and the cylinder with predetermined force.

An ink supply needle may be provided instead of the suction tube 42 which is protrusively provided in the substrate 40 and the ink supply apparatus 27 may also function as a cartridge holder.

The rotating type pump is not limited to being a gear pump. A screw pump, a tube pump, a vane pump or the like may be employed.

The magnetic body which is a material of at least the outer circumferential section of the pump driver may be made of nickel, cobalt and the like. In addition, the driving gear 51 is not limited to a metal sintered body and a metal material (magnetic body) may be processed in a gear shape.

When the magnetic pole section of the magnetic rotating body is configured with a magnet, a rare earth magnet such as a samarium-cobalt magnet or a neodymium magnet may be employed as the magnet. A ferrite magnet and an alnico magnet may be also used.

The liquid ejecting apparatus is not limited to a serial printer and an ink jet type line printer may be used. In this case, the recording head may be any of a full line type recording head or a multi-head type recording head.

The liquid ejecting apparatus is embodied as the ink jet type printer in the embodiment. However, there is no limitation thereto and the liquid ejecting apparatus can be embodied as a liquid ejecting apparatus which ejects or discharges liquids other than ink (including a liquid body where particles of a functional material are dispersed, or mixed in a liquid and a fluid such as gel). For example, there may be a liquid ejecting apparatus configured to eject a liquid body including materials such as an electrode material or a coloring material (pixel material) used for manufacturing liquid crystal displays, EL (electroluminescence) displays, surface-emission-type displays in a dispersed or dissolved state. In addition, there may be a liquid ejecting apparatus which ejects a bioorganic substance used for manufacturing biochips and a liquid ejecting apparatus used as a precise pipette and configured to eject liquid as samples. Moreover, a liquid ejecting apparatus configured to eject transparent resin liquid such as thermal cured resin on a substrate for forming micro semispherical lenses (optical lenses) used for optical communication elements, a liquid ejecting apparatus configured to eject etching solution such as acid or alkali for etching a substrate or the like, and a fluid ejecting apparatus configured to eject a fluid such as gel (for example, physical gel) may be used. Then, the invention can be applied to one of these liquid ejecting apparatuses. In such a manner, the medium is not limited to a sheet such as paper (continuous paper and cut paper) and a substrate in which elements and wiring are formed by an ink jet method may be used. In addition, a sheet made of synthetic resin or metal may be used. Further, the "liquid" in the specification includes a liquid (including inorganic solvents, organic solvents, solutions, liquid resins, and liquid metals (metal melt)), a liquid body, a fluid and the like.

What is claimed is:

1. A liquid supply apparatus which supplies a liquid to a liquid ejecting head from a liquid accommodating unit comprising:

a plurality of rotating type pumps which are respectively provided in the middle of each of a plurality of supply paths which connects a plurality of the liquid accommodating units and the liquid ejecting head;

a common power source which drives the plurality of pumps; and a power transmission adjusting unit which adjusts power which is transmitted from the power source to each pump and by which when a load that the pump receives due to the liquid pressure in a discharge flow path of the supply path which discharges the liquid from the pump is equal to or less than a connection limit, the power source and the pump are connected to transmit the power from the power source to the pump and when the load exceeds the connection limit, a slip occurs in the connection for transmitting the power from the power source to the pump so that the power transmission is shut off or the transmitted power is reduced.

2. The liquid supply apparatus according to claim 1, wherein each pump has a pump driver provided in a pump chamber to be rotatable, and the power transmission adjusting unit has one or a plurality of magnetic rotating bodies each rotating by the power from the power source and having a magnetic pole section in which different magnetic poles are alternately provided on an outer circumferential surface and the magnetic body provided in at least an outer circumferential section of each of the pump drivers and the plurality of pump drivers are arranged with a gap in which the magnetic force can work with the magnetic pole section of each magnetic rotating body so that the magnetic rotating bodies and the pump drivers are connected to transmit the power through the magnetic force.

3. The liquid supply apparatus according to claim 2, wherein one magnetic rotating body is provided and the plurality of pump drivers which form each of the pumps are arranged along the outer circumferential surface of the magnetic rotating body in a state of being arranged with a gap in which the magnetic force can work with the magnetic pole section of the one magnetic rotating body.

4. A liquid ejecting apparatus comprising:

a liquid ejecting head;

the liquid supply apparatus which supplies a liquid to the liquid ejecting head by discharging the liquid sent from the liquid accommodating unit from the pump through the supply path according to claim 3; and a transporting unit which transports a medium, to which the liquid ejecting head ejects a liquid, as a target.

5. The liquid supply apparatus according to claim 2, further comprising a substrate which has a flow path forming member in which a groove for a flow path is formed and a film bonded to a surface of the flow path forming member in which the groove is formed, and in which each of the pumps is embedded between a suction flow path and the discharge flow path formed by being partitioned by the groove and the film, wherein the one magnetic rotating body is embedded in the substrate and the plurality of pumps are radially arranged around the magnetic rotating body as a center.

6. A liquid ejecting apparatus comprising:

a liquid ejecting head;

the liquid supply apparatus which supplies a liquid to the liquid ejecting head by discharging the liquid sent from the liquid accommodating unit from the pump through the supply path according to claim 5; and a transporting unit which transports a medium, to which the liquid ejecting head ejects a liquid, as a target.

7. A liquid ejecting apparatus comprising:

a liquid ejecting head;

the liquid supply apparatus which supplies a liquid to the liquid ejecting head by discharging the liquid sent from the liquid accommodating unit from the pump through the supply path according to claim 2; and a transporting unit which transports a medium, to which the liquid ejecting head ejects a liquid, as a target.

8. The liquid supply apparatus according to claim 1, wherein each pump has a pump driver provided in a pump chamber to be rotatable, and the power transmission adjusting unit is a fraction clutch provided on a power transmission path which individually transmits the power of the power source to each of the pump drivers.

9. The liquid supply apparatus according to claim 8, wherein the fraction clutch is interposed between a rotation shaft which rotates by the power of the power source and the pump driver which is provided to the rotation shaft to be relatively rotatable.

10. A liquid ejecting apparatus comprising:

a liquid ejecting head;

the liquid supply apparatus which supplies a liquid to the liquid ejecting head by discharging the liquid sent from the liquid accommodating unit from the pump through the supply path according to claim 9; and a transporting unit which transports a medium, to which the liquid ejecting head ejects a liquid, as a target.

11. A liquid ejecting apparatus comprising:

a liquid ejecting head;

the liquid supply apparatus which supplies a liquid to the liquid ejecting head by discharging the liquid sent from the liquid accommodating unit from the pump through the supply path according to claim 8; and a transporting unit which transports a medium, to which the liquid ejecting head ejects a liquid, as a target.

12. A liquid ejecting apparatus comprising:

a liquid ejecting head;

the liquid supply apparatus which supplies a liquid to the liquid ejecting head by discharging the liquid sent from the liquid accommodating unit from the pump through the supply path according to claim 1; and a transporting unit which transports a medium, to which the liquid ejecting head ejects a liquid, as a target.

* * * * *